US008439484B2

(12) United States Patent
Kim et al.

(10) Patent No.: US 8,439,484 B2
(45) Date of Patent: May 14, 2013

(54) PNEUMATIC DISPENSER

(75) Inventors: Joon-Won Kim, Pohang-si (KR); Sang-Min Lee, Busan (KR)

(73) Assignee: Postech Academy-Industry Foundation, Pohang (KR)

( * ) Notice: Subject to any disclaimer, the term of this patent is extended or adjusted under 35 U.S.C. 154(b) by 304 days.

(21) Appl. No.: 12/992,622

(22) PCT Filed: May 22, 2009

(86) PCT No.: PCT/KR2009/002722

§ 371 (c)(1),
(2), (4) Date: Nov. 15, 2010

(87) PCT Pub. No.: WO2009/151218

PCT Pub. Date: Dec. 17, 2009

(65) Prior Publication Data

US 2011/0073619 A1 Mar. 31, 2011

(30) Foreign Application Priority Data

Jun. 9, 2008 (KR) ..... 10-2008-0053813

(51) Int. Cl.
*B41J 2/04* (2006.01)
*B41J 2/135* (2006.01)
*B41J 2/05* (2006.01)

(52) U.S. Cl.
USPC ..... 347/54; 347/44; 347/65

(58) Field of Classification Search ..... None
See application file for complete search history.

(56) References Cited

U.S. PATENT DOCUMENTS

| | | | | |
|---|---|---|---|---|
| 4,924,241 | A * | 5/1990 | Parks et al. | 347/54 |
| 5,943,079 | A | 8/1999 | Yoshida | |
| 2003/0151218 | A1 | 8/2003 | Swaffield | |
| 2003/0205628 | A1 | 11/2003 | Aizawa et al. | |
| 2005/0052502 | A1 * | 3/2005 | Chung et al. | 347/65 |

FOREIGN PATENT DOCUMENTS

| | | |
|---|---|---|
| EP | 1579999 | 9/2005 |
| JP | 61-501581 | 7/1986 |
| JP | 06-198872 | 7/1994 |
| JP | 06-198873 | 7/1994 |
| JP | 2001-248561 | 9/2001 |
| JP | 2002-530573 | 9/2002 |
| JP | 2006-247879 | 9/2006 |
| JP | 2007-092694 | 4/2007 |
| JP | 2007-331350 | 12/2007 |
| KR | 10-2006-0039111 | 5/2006 |
| WO | 8503982 | 9/1985 |

* cited by examiner

*Primary Examiner* — Geoffrey Mruk
(74) *Attorney, Agent, or Firm* — Lexyoume IP Meister, PLLC.

(57) ABSTRACT

A pneumatic dispenser (1) according to the present invention includes: a first plate (10) including a liquid supply unit (11), a first chamber (C1) connected to the liquid supply unit (11), and a liquid discharge unit (12) connected to the first chamber (C1), a flexible membrane (20) at least installed on the first chamber (C1) of the first plate (10) and establishing one side of the first chamber (C1), a second plate (30) including a second chamber (C2) at a side opposite to the first chamber (C1) while facing the first plate (10) with the flexible membrane (20) interposed there between and a bump (40) formed by protruding the liquid supply unit (11) toward the flexible membrane (20).

10 Claims, 4 Drawing Sheets

PNEUMATIC DISPENSER

TECHNICAL FIELD

The present invention relates to a pneumatic dispenser, and more particularly, to a pneumatic dispenser that limits backflow at the time of discharging a liquid by adopting a bump.

BACKGROUND ART

An example of a dispenser that discharges a liquid includes an inkjet head. The inkjet head may be classified as a thermal bubble inkjet head and a piezoelectric inkjet head.

In the thermal bubble inkjet head, when bubbles are generated in a heater, the bubbles flow back in a direction opposite to a liquid discharge outlet (for example, a nozzle of the inkjet head).

In the piezoelectric inkjet head, the liquid flows back in the direction opposite to the liquid discharge nozzle even in a scheme of pressing a thin film connected with a chamber.

A dispenser that discharges the liquid, i.e., the inkjet head, is provided with a flow restriction device (restrictor or neck) on a flow path connected to a liquid supply unit so as to suppress backflow of the bubbles or backflow of the liquid.

For example, the flow restriction device increases flow resistance in a backflow direction by forming a flow path in a backflow direction of the liquid that has a relatively smaller cross-sectional area than a flow path in a discharge direction of the liquid to thereby suppress the backflow of the liquid.

As such, in the case of adopting the flow restriction device for forming the smaller cross-sectional area of the flow path, the dispenser is restrictedly used depending on the size of minute particles or cells included in a discharged liquid. That is, in the dispenser, the minute particles may block a gap between the liquid supply unit and a pressure chamber.

The above information disclosed in this Background section is only for enhancement of understanding of the background of the invention and therefore it may contain information that does not form the prior art that is already known in this country to a person of ordinary skill in the art.

DISCLOSURE

Technical Problem

The present invention has been made in an effort to provide a pneumatic dispenser having an advantage of discharging a liquid including minute particles at an accurate amount.

Technical Solution

The present invention has been made in an effort to provide a pneumatic dispenser having other advantages of being simply structured, low in price, and able to be mass produced.

An exemplary embodiment of the present invention provides a pneumatic dispenser that includes: a first plate including a liquid supply unit, a first chamber connected to the liquid supply unit, and a liquid discharge unit connected to the first chamber; a flexible membrane at least installed on the first chamber of the first plate and establishing one side of the first chamber; a second plate including a second chamber at a side opposite to the first chamber while facing the first plate with the flexible membrane interposed therebetween; and a bump formed by protruding the liquid supply unit toward the flexible membrane.

The flexible membrane may be formed in correspondence with the first plate and the second plate.

The flexible membrane may include a fixing unit fixed between the first plate and the second plate, and a driving unit that performs a pumping operation between the first chamber and the second chamber. The flexible membrane may be made of polydimethylsiloxane (PDMS).

The first chamber that is one side of the driving unit may constitute a liquid chamber that supplies and discharges a liquid and a second chamber that is the other side of the driving unit may constitute a pneumatic chamber that forms negative pressure and positive pressure.

The first chamber and the second chamber may have the same area on the same center line.

The first chamber is formed of a cylindrical groove, and the bump may cylindrically protrude in correspondence with the center of the flexible membrane.

On the basis of the bottom of the first chamber, a protruding height of the bump may be lower than a groove height of the first chamber.

The liquid supply unit includes an inlet connected to the first chamber, and the bump protrudes from the bottom of the first chamber to the flexible membrane to extend the inlet toward the flexible membrane.

The liquid discharge unit includes a discharge outlet connected to the first chamber, and the first chamber further includes a flow path connected to the discharge outlet.

Advantageous Effects

As described above, according to one exemplary embodiment of the present invention, when the bump is formed by protruding the liquid supply unit toward the flexible membrane and preventing the liquid from flowing back by blocking the liquid supply unit with the flexible membrane at the time of discharging the liquid, the liquid is discharged by secondary deformation of the flexible membrane to thereby quantitatively discharge the liquid containing minute particles.

Further, since the pneumatic dispenser of one exemplary embodiment allows the pneumatic pressure (negative pressure and positive pressure) to act on the second chamber without using an electrical device, a simple structure, a low price, and mass production can be achieved.

MODE FOR INVENTION

Figure 1:
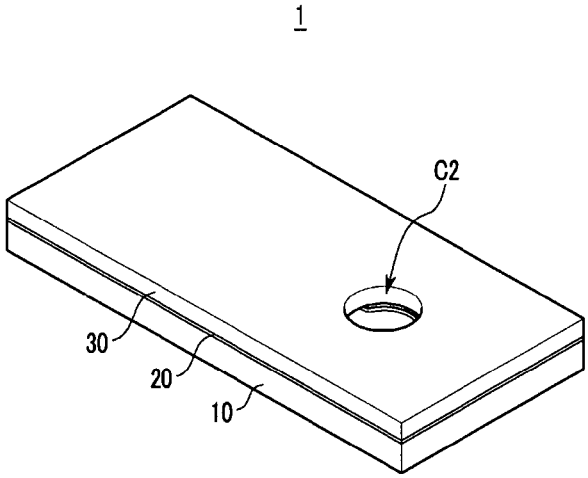
FIG. 1 is a perspective view of a pneumatic dispenser according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

Figure 2:
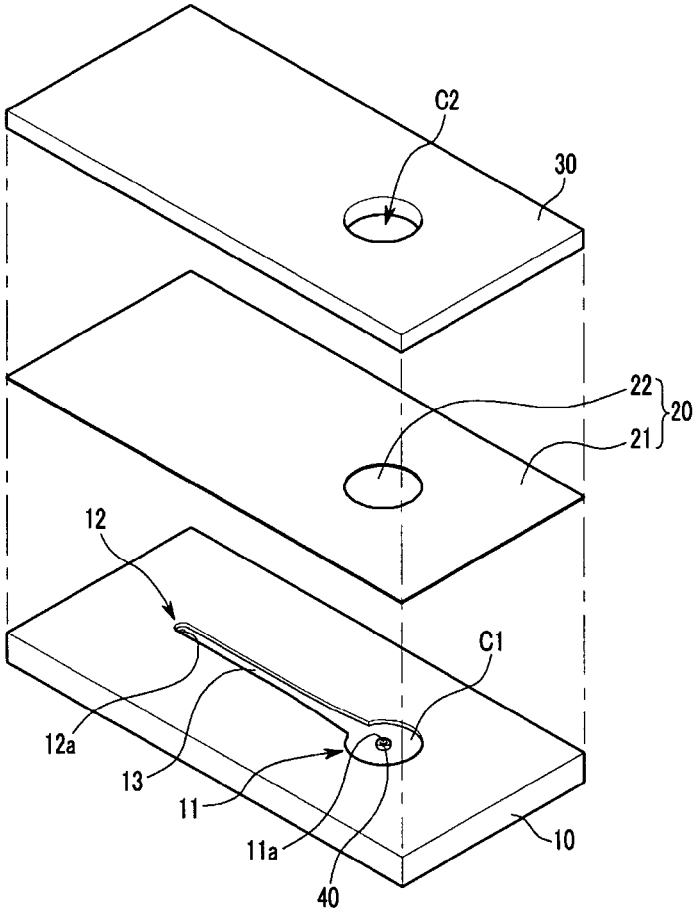
FIG. 2 is an exploded perspective view of the pneumatic dispenser of FIG. 1.

FIG. 1 is a perspective view of a pneumatic dispenser according to an exemplary embodiment of the present invention, and FIG. 2 is an exploded perspective view of the pneumatic dispenser of FIG. 1.

Referring to FIGS. 1 and 2, the pneumatic dispenser 1 is configured to quantitatively discharge a liquid and another liquid including minute particles or cells. As an example, the pneumatic dispenser 1 includes a first plate 10, a flexible membrane 20, a second plate 30, and a bump 40.

The first plate 10 and the second plate 30 are bonded to each other with the flexible membrane 20 interposed therebetween. The first plate 10 is configured to supply and discharge a liquid. The second plate 30 is configured to make pneumatic pressure (negative pressure and positive pressure) act on the flexible membrane 20.

For example, the first plate 10 includes a liquid supply unit 11, a first chamber C1, and a liquid discharge unit 12, and constitutes a body of the pneumatic dispenser 1. The second plate 30 constitutes a second chamber C2 corresponding to the first chamber C1.

The flexible membrane 20 is installed on the first plate 10 and establishes one side of the first chamber C1. The flexible membrane 20 is at least installed to face the first chamber C1.

In the exemplary embodiment, the flexible membrane 20 is formed to face the first plate 10 and the second plate 30. That is, the flexible membrane 20 has the same area as the first plate 10 and the second plate 30 in an assembled state.

The flexible membrane 20 includes a fixing unit 21 and a driving unit 22. The fixing unit 21 is fixed between the first plate 10 and the second plate 30 that face each other. The driving unit 22 is disposed between the first chamber C1 and the second chamber C2. The driving unit 22 moves toward the first chamber C1 and the second chamber C2 to perform a pumping operation.

For example, the flexible membrane 20 may be made of polydimethylsiloxane (PDMS).

The flexible membrane 20 establishes opposed sides of the first chamber C1 and the second chamber C2 between the first plate 10 and the second plate 30, respectively. The driving unit 22 and the first chamber C1, which is one side of the driving unit 22, constitute a liquid chamber that supplies and discharges the liquid. The driving unit 22 and the second chamber C2, which is the other side of the driving unit 22, constitute a pneumatic chamber generating the negative pressure and the positive pressure.

Figure 3:
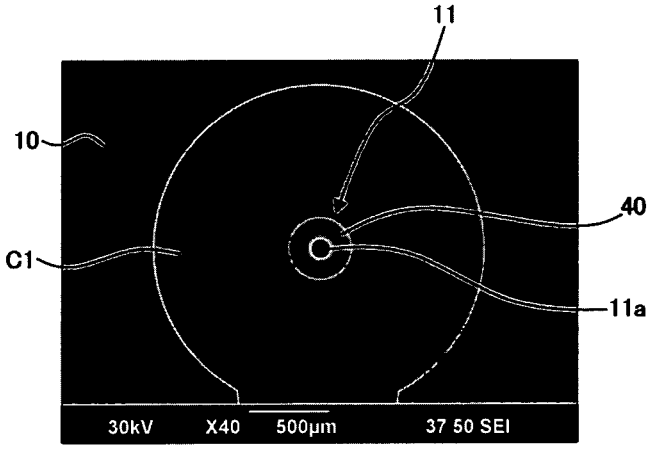
FIG. 3 is a plan view of a first chamber in a first plate.
Figure 4:
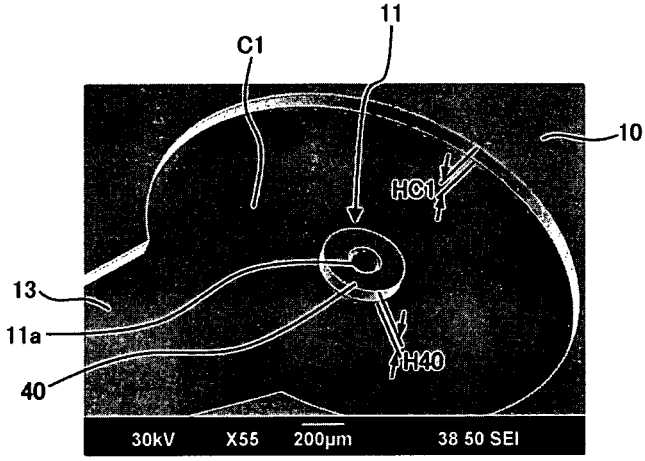
FIG. 4 is a partial perspective view of a flow path connected to a first chamber in a first plate.
Figure 5:
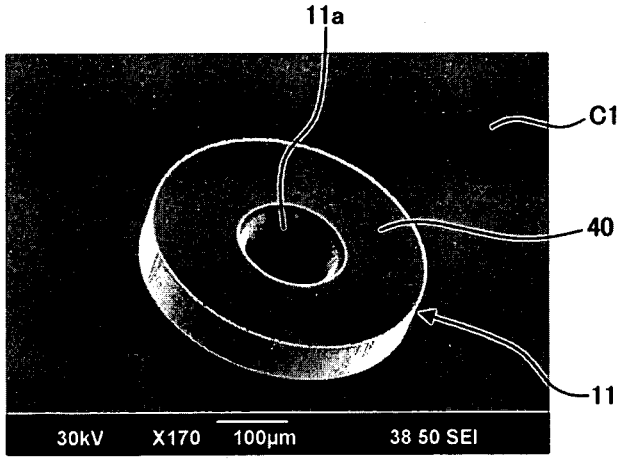
FIG. 5 is an enlarged plan view of a bump and an inlet in a first chamber.

FIG. 3 is a plan view of the first chamber in the first plate, FIG. 4 is a partial perspective view of the flow path connected to the first chamber in the first plate, and FIG. 5 is an enlarged plan view of a bump and a discharge outlet in the first chamber.

Referring to FIGS. 3 to 5, the first chamber C1 and the second chamber C2 are formed by cylindrical grooves disposed on the same center line and having the same area. Accordingly, the negative pressure and the positive pressure acting on the second chamber C2 effectively act on the first chamber C1 through the driving unit 22 of the flexible membrane 20.

When the flexible membrane 20 discharges the liquid to the liquid discharge unit 12 between the first plate 10 and the second plate 30, the bump 40 prevents the discharged liquid from flowing back to the liquid supply unit 11. For example, the bump 40 is formed by protruding the liquid supply unit 11 to the flexible membrane 20.

The first chamber C1 is formed of the cylindrical groove. The bump 40 cylindrically protrudes in the first chamber C1 in correspondence with the center of the flexible membrane 20. A protruding height H40 of the bump 40 is lower than a groove height HC1 of the first chamber C1 on the basis of the bottom of the first chamber C1.

The liquid supply unit 11 connected to the first chamber C1 includes an inlet 11*a*. The inlet 11*a* is formed in the bump 40. That is, the bump 40 protrudes from the bottom of the first chamber C1 to the flexible membrane 20, such that the inlet lla of the liquid supply unit 11 extends toward the flexible membrane 20. In discharging the liquid, the flexible membrane 20 is further pressurized after the inlet 11*a* is blocked.

Figure 6:
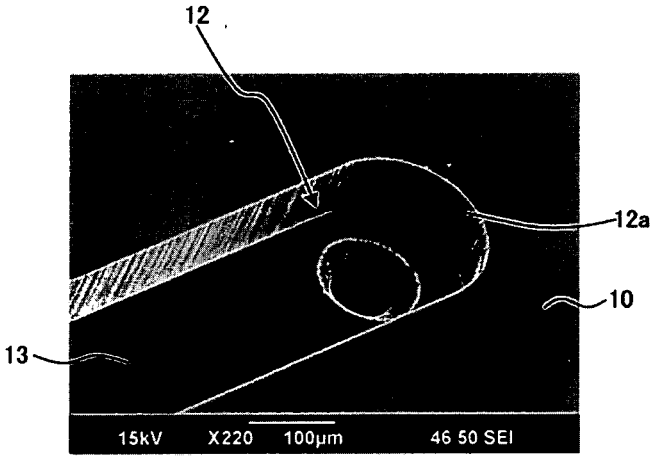
FIG. 6 is a perspective view of a liquid discharge unit in a first plate.

FIG. 6 is a perspective view of the liquid discharge unit in the first plate.

Referring to FIG. 6, in the first plate 10, the liquid discharge unit 12 includes a discharge outlet 12*a* connected to the first chamber C1. The first chamber C1 and the discharge outlet 12*a* are connected to each other through a flow path 13.

The flow path 13 is formed at the same height as the groove height HC1 of the first chamber C1. Therefore, the protruding height H40 of the bump 40 is lower than the groove height HC1 of the flow path 13. One side of the flow path 13 is established by the flexible membrane 20.

Hereinafter, a manufacturing process of the pneumatic dispenser 1 will be described. As an example, the liquid supply unit 11, the liquid discharge unit 12, and the flow path 13 are formed on the first plate 10 by a silicon dry etching method.

That is, by the silicon dry etching method consisting of two steps, the first chamber C1, the flow path 13, and the bump 40 are formed. The bump 40 is formed by first-step etching, and the first chamber C1 and the flow path 13 are formed by second-step etching that is performed in addition to the first-step etching.

Therefore, the groove height HC1 of each of the first chamber C1 and the flow path 13 is different from the protruding height H40 of the bump 40 protruding on the first chamber C1. For example, a height of the bump 40 may be different from those of the flow path 13 and the first chamber C1 by approximately 20 mm.

Since the height HC1 of each of the flow path 13 and the first chamber C1 is higher than the height H40 of the bump 40, the flexible membrane 20 is not attached to the bump 40 when the flexible membrane 20 is in contact with the first plate 10.

After the first chamber C1, the flow path 13, and the bump 40 are formed, one surface of the first plate 10 opposite to the first chamber C1 is disposed on the surface of the first chamber C1 and is patterned. Thereafter, the inlet 11*a* of the liquid supply unit 11 and the discharge outlet 12*a* of the liquid discharge unit 12 are formed by the silicon dry etching method.

The flexible membrane 20 is formed by using the PDMS. For example, an inner surface of the second plate 30 is coated with the PDMS at several tens to hundreds of mm and is cured at approximately 70 ℃, such that the PDMS is fabricated on the inner surface of the second plate 30.

The surface of the fabricated PDMS is treated by using oxygen plasma for approximately 30 seconds, and the second plate 30 in which the flexible membrane 20 is formed is bonded to the first plate 10. As a result, the flexible membrane 20 is interposed between the first plate 10 and the second plate 30.

In addition, the second chamber C2 is formed by forming a hole in the second plate 30 corresponding to the first chamber C1. The second chamber C2 has the same diameter as the first chamber C1. The second chamber actuates the driving unit 22 of the flexible membrane 20 by actuation of the pneumatic pressure, that is, the negative pressure or the positive pressure.

Figure 7:
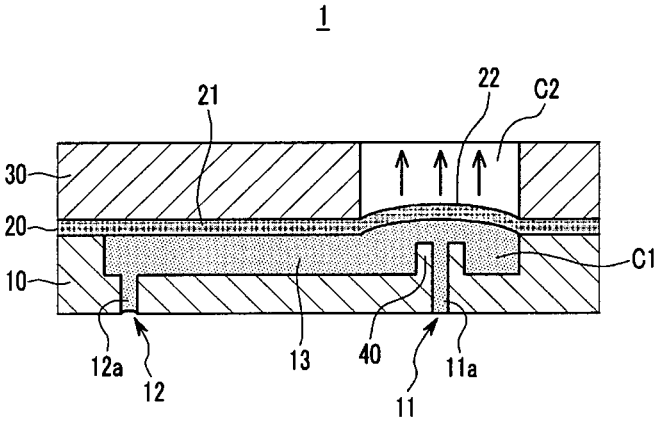
FIGS. 7 to 9 are diagrams illustrating an operational state of the pneumatic dispenser of FIG. 1.
Figure 8:
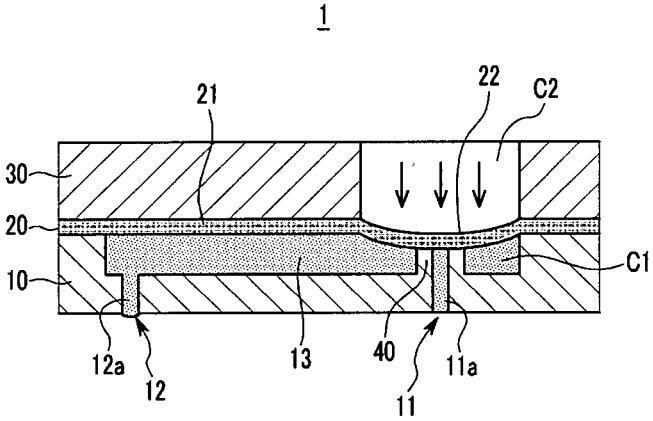
Figure 9:
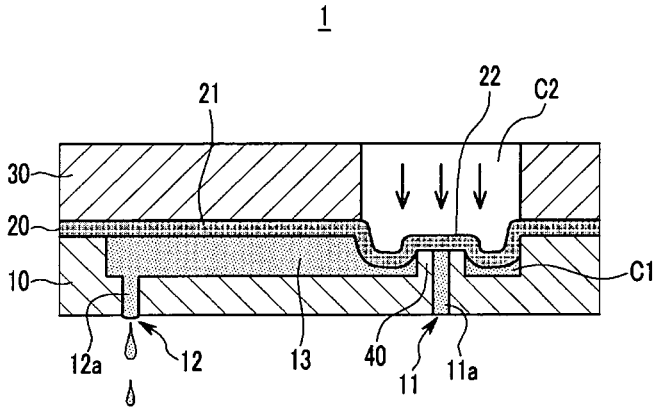

FIGS. 7 to 9 are diagrams illustrating an operational state of the pneumatic dispenser of FIG. 1. Referring to FIGS. 7 to 9, an operation of the pneumatic dispenser 1 will be described.

Referring to FIG. 7, when the negative pressure acts on the second chamber C2, the driving unit 22 of the flexible membrane 20 extends from the first chamber C1 to the second chamber C2 to form the negative pressure in the first chamber C1.

The liquid is inputted into the first chamber C1 and the flow path 13 through the inlet 11*a* of the liquid supply unit 11 by the negative pressure.

Referring to FIG. 8, when the negative pressure is released from the second chamber C2 and the positive pressure acts on the second chamber C2, the driving unit 22 of the flexible membrane 20 is pressurized from the second chamber C2 to the first chamber C1 to be closely contacted with the bump 40, thereby blocking the inlet 11*a*.

Even though the flexible membrane 20 is pressurized, the flow of the liquid in the first chamber C1 and the flow path 13 is kept blocked without flowing back through the inlet 11*a* of the liquid supply unit 11 by blocking the inlet 11*a*.

Referring to FIG. 9, when the larger positive pressure acts on the second chamber C2, the driving unit 22 of the flexible membrane 20 pressurizes the inside of the first chamber C1 by being further pressurized from the second chamber C2 to the first chamber C1 while blocking the inlet 11*a* in close contact with the bump 40.

Since the first chamber C1 is pressurized in a state in which the inlet 11*a* is blocked, the liquid in the first chamber C1 and the flow path 13 is discharged through the discharge outlet 12*a* of the liquid discharge unit 12.

At this time, the liquid discharged through the discharge outlet 12*a* can be quantitatively controlled by controlling the magnitude and operation time of the positive pressure acting on the second chamber C2.

As such, the pneumatic dispenser 1 of the exemplary embodiment discharges the liquid to the discharge outlet 12*a* maintaining its diameter in a state in which the flexible membrane 20 fully blocks the inlet 11*a* in close contact with the bump 40.

Therefore, the pneumatic dispenser 1 of an exemplary embodiment may quantitatively discharge the liquid including various minute particles and cells and may be adopted primarily in a field requiring the quantitative discharge, i.e., a bio-related test apparatus.

Further, since the pneumatic dispenser 1 of one exemplary embodiment has a simple structure that is actuated by the pneumatic pressure without an electrical structure, the pneumatic dispenser 1 can be manufactured at a low price and by various methods.

Accordingly, the pneumatic dispenser 1 of an exemplary embodiment can be easily adopted in a system requiring discharge of the liquid to thereby help developing an integrated system, i.e., a lab-on-a-chip system.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A pneumatic dispenser comprising:

a first plate including a liquid supply unit, a first chamber connected to the liquid supply unit, and a liquid discharge unit connected to the first chamber;

a flexible membrane installed at least on the first chamber of the first plate and that establishes one side of the first chamber;

a second plate facing the first plate such that the flexible membrane is positioned between the first plate and the second plate, the second plate including a second chamber at a side opposite to the first chamber; and a bump formed by being protruded from the liquid supply unit toward the flexible membrane, wherein the first chamber, the second chamber, and the bump are aligned on a same center line.

2. The pneumatic dispenser of claim 1, wherein the flexible membrane is formed in correspondence with the first plate and the second plate.

3. The pneumatic dispenser of claim 2, wherein the flexible membrane includes:

a fixing unit fixed between the first plate and the second plate; and a driving unit that performs a pumping operation between the first chamber and the second chamber.

4. The pneumatic dispenser of claim 3, wherein the flexible membrane is made of polydimethylsiloxane (PDMS).

5. The pneumatic dispenser of claim 3, wherein the first chamber that is one side of the driving unit constitutes a liquid chamber that supplies and discharges a liquid, and a second chamber that is the other side of the driving unit constitutes a pneumatic chamber that forms negative pressure and positive pressure.

6. The pneumatic dispenser of claim 5, wherein the first chamber and the second chamber have the same area size.

7. The pneumatic dispenser of claim 6, wherein the first chamber is formed of a cylindrical groove, and the bump cylindrically protrudes in correspondence with the center of the flexible membrane.

8. The pneumatic dispenser of claim 7, wherein, on the basis of the bottom of the first chamber, a protruding height of the bump is lower than a groove height of the first chamber.

9. The pneumatic dispenser of claim 1, wherein the liquid supply unit includes an inlet connected to the first chamber, and the bump protrudes from the bottom of the first chamber to the flexible membrane to extend the inlet toward the flexible membrane.

10. The pneumatic dispenser of claim 9, wherein the liquid discharge unit includes a discharge outlet connected to the first chamber, and the first chamber further includes a flow path connected to the discharge outlet.

* * * * *